US006301871B1

(12) United States Patent
Recchia

(10) Patent No.: US 6,301,871 B1
(45) Date of Patent: Oct. 16, 2001

(54) ROTATING WINCH FOR STRANDING LINES

(75) Inventor: Fabrizio Recchia, Concorezzo (IT)

(73) Assignee: Officine Meccaniche Di Lesmo S.p.A., Lesmo (IT)

( * ) Notice: Subject to any disclaimer, the term of this patent is extended or adjusted under 35 U.S.C. 154(b) by 0 days.

(21) Appl. No.: 09/392,816

(22) Filed: Sep. 9, 1999

(30) Foreign Application Priority Data

Apr. 16, 1999 (IT) ..... MI99A0803

(51) Int. Cl.[7] ..... H01B 13/02; H01B 13/26; D07B 3/10

(52) U.S. Cl. ..... 57/315; 57/58.52; 57/58.83; 57/98; 57/311; 226/190

(58) Field of Search ..... 57/9, 58.52, 58.83, 57/98, 315; 226/190

(56) References Cited

U.S. PATENT DOCUMENTS 3,147,581 * 9/1964 Godderidge ..... 57/58.63
3,981,131 * 9/1976 Hartig et al. ..... 57/58.54
4,328,662 * 5/1982 Bretegnier et al. ..... 57/58.61
4,599,853 * 7/1986 Varga-Papp ..... 57/9
4,785,617 * 11/1988 Bourgois et al. ..... 57/58.52

* cited by examiner

*Primary Examiner*—Andy Falik
(74) *Attorney, Agent, or Firm*—Akin, Gump, Strauss, Hauer & Feld, L.L.P.

(57) ABSTRACT

Rotating winch for stranding lines comprising a hollow rotor (1) wherein a motor (9) suitable for rotating a drawing drum (12) around an axis perpendicular to the axis of rotation of the rotor (1) is arranged, the external lateral surface (21) of said drawing drum (12) having a substantially concave profile which is included between two containment walls (22, 22'). Said profile is preferably symmetrical and has a substantially constant radius of curvature, equal to about the double of the distance between the containment walls (22, 22') and to about ⅔ of the external diameter at the center of the drawing drum.

10 Claims, 2 Drawing Sheets

ROTATING WINCH FOR STRANDING LINES

BACKGROUND OF THE INVENTION

The present invention relates to a rotating winch, and particularly to a rotating winch that can be used in stranding lines in order to pull the strand coming from the compacting die and to release it in tension to a stranding machine, particularly to a double-twist stranding machine.

Rotating winches for stranding lines are known to comprise generally a hollow rotor wherein a motor suitable for rotating a drawing cylindrical drum around an axis perpendicular to the axis of rotation of the rotor is arranged. The contemporaneous rotation of the drawing drum around its axis and around the rotor axis allows the strand threads coming from the compacting die to be pulled and stranded at the same time, so that the stranding machine is supplied with a strand which is nearly ready to be stored onto a bobbin. Said known winches have the problem that they must necessarily be provided with mechanical means for moving the strand position on the drawing drum in order to avoid undesired and dangerous overlappings of the turns due to the high tensions and to the high twisting moments to which the strand itself is subjected.

BRIEF SUMMARY OF THE INVENTION

Therefore, object of the present invention is providing a rotating winch which is free from said problem, that is a rotating winch wherein the strand coming from the compacting die chaser can be naturally rolled up around the drawing drum without the help of particular mechanical means and without the risk of overlappings. Said object is obtained by means of a rotating winch whose main features are disclosed in the first claim and other features are disclosed in the following claims.

Thanks to the particular profile and to the containment walls of the external lateral surface of the drawing drum, the strand being inlet into the rotating winch according to the present invention arranges itself around the drawing drum automatically and without overlapping risks. In fact, owing to the traction difference whereto the strand being inlet and outlet from the winch rotor are subjected, the strand undergoes a lengthening which gradually decreases as the traction around the circumference of the drawing drum decreases, according to the known law $T=e^{k\alpha}$, wherein T is the traction, k a friction coefficient and $\alpha$ the angle defined by the strand around the drum. Therefore, external conditions being equal, the strand tends to arrange itself on the decreasing circumferences of the external profile of the new drawing drum, and therefore the turns have the natural tendency to roll towards the center of the profile itself, which has a smaller diameter.

For this purpose, the ratio between the drawing drum diameter near to the containment walls and the diameter at the center of the drawing drum is preferably proportional to the ratio between the tension of the strand being inlet into the rotor and the tension of the strand being outlet from the rotor. Moreover, the profile of the external lateral surface of the drawing drum has preferably a constant radius of curvature, which is about the double of the distance between the containment walls and about ⅔ of the external diameter at the center of the drawing drum.

According to a particular aspect of the present invention, the profile of the external lateral surface of the drawing drum is symmetrical with respect to a central plane perpendicular to the axis of rotation of the drum itself. By this arrangement, it is possible to use the rotating winch with strands laid both clockwise and anticlockwise.

BRIEF DESCRIPTION OF THE SEVERAL VIEWS OF THE DRAWINGS

Further advantages and features of the rotating winch according to the present invention will be apparent to those which are skilled in the art from the following detailed description of an embodiment thereof with reference to the accompanying drawings, wherein.

DETAILED DESCRIPTION OF THE INVENTION

Figure 1:
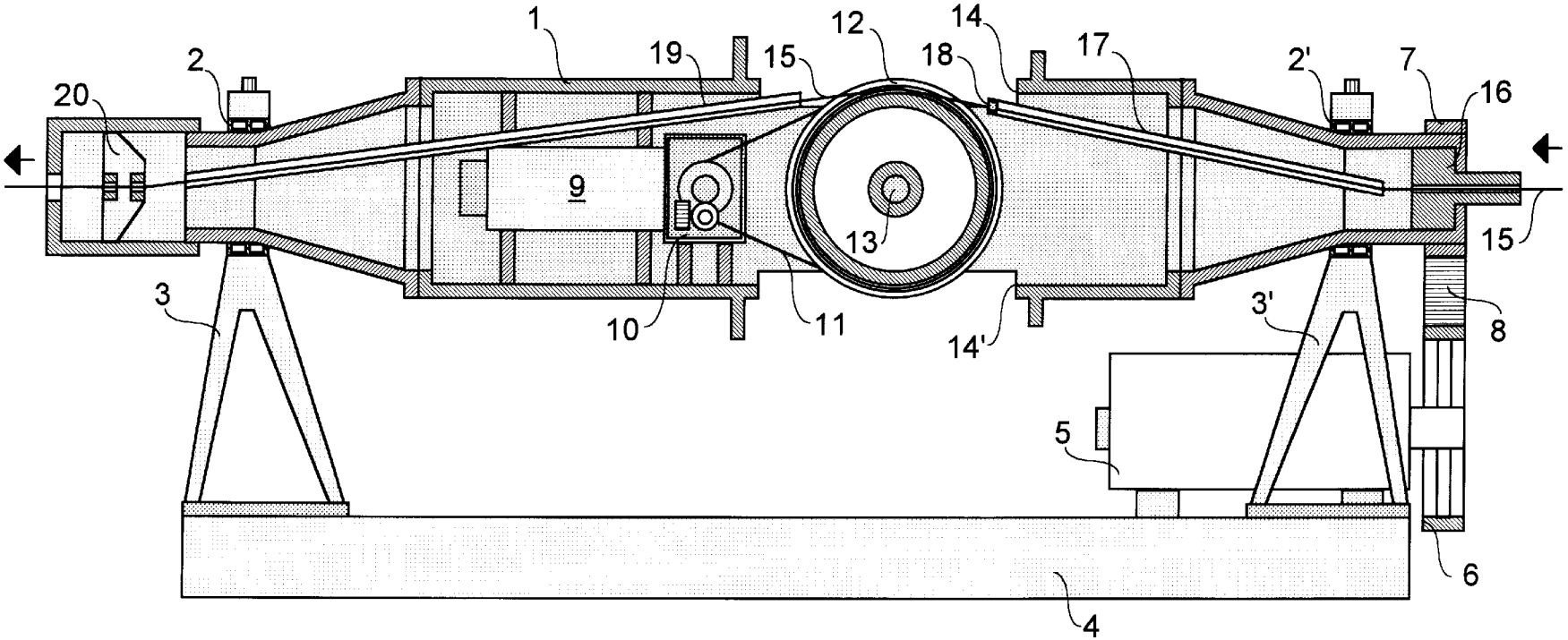
FIG. 1 shows a lateral view in longitudinal section of the rotating winch according to said embodiment of the present invention.

With reference to FIG. 1, the rotating winch according to one embodiment of the present invention is shown to comprise in a known way a hollow rotor 1 having a substantially cylindrical shape with tapered ends, which, by means of bearings 2, 2', pivotally rests on a pair of supports 3, 3' fastened to a base 4. Rotor 1 is rotated around its longitudinal and horizontal axis by a motor 5 whose shaft is connected to the rotor by means of a pair of cog pulleys 6, 7 and one cog belt 8. Inside rotor 1 there is inserted a further motor 9, which transmits the motion, by means of a motor reducer 10 and of a pair of belts 11 (only one being shown in the figure), to a pair of pulleys (not shown in the figure) integral with a drawing drum 12 fastened to a shaft 13 suitable for rotating around an axis perpendicular to the axis of rotation of the rotor 1. The lateral surface of drawing drum 12 is accessible from the outside by virtue of a pair of openings 14, 14' made in rotor 1 in order to check the passage of the end of strand 15 at the beginning of the stranding operations. In fact strand 15, coming from the compacting die (not shown in the figure) passes through a first bushing 16 fastened to one end of rotor 1, a tubular whipping 17, at least one guide 18 positioned at the internal end of this whipping 17 and finally winds itself around drawing drum 12. After having made a few turns around drawing drum 12, strand 15 passes through a further tubular whipping 19 and a pair of guides 20, in order to get out of rotor 1 and go towards a stranding machine, for example a double-twist stranding machine.

Figure 2:
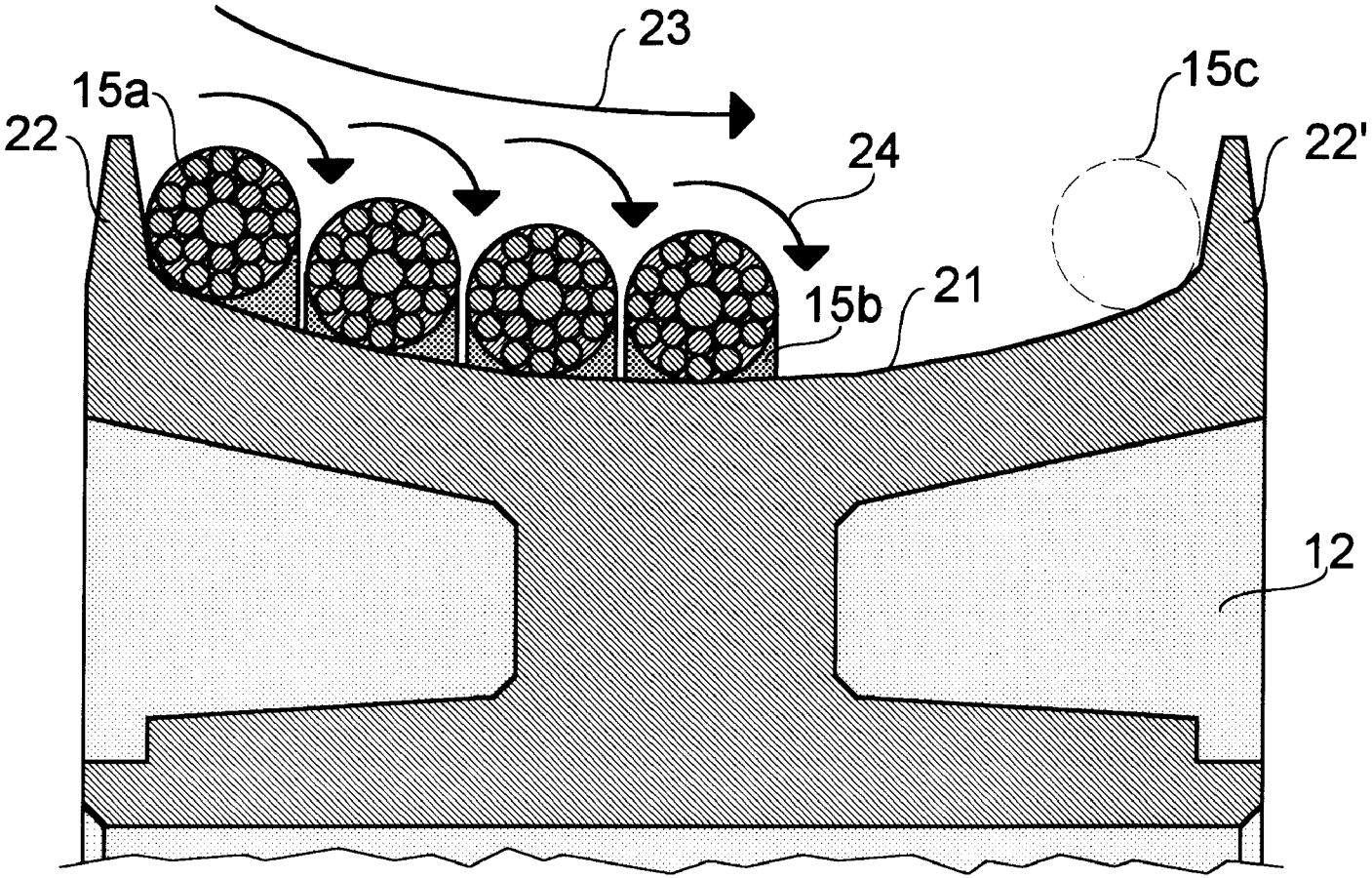
FIG. 2 shows a partial lateral view in cross-section of the drawing drum of FIG. 1.

Now, with reference to FIG. 2, the external lateral surface 21 of drawing drum 12 is shown to be suitably provided with a substantially concave profile which is included between two containment walls 22, 22'. Said concave profile is preferably symmetrical with respect to a central plane perpendicular to the axis of rotation of drawing drum 12, as well as curvilinear with a radius of curvature substantially constant and equal to about the double of the distance between containment walls 22, 22'. Particularly, in the present embodiment, the distance between containment walls 22 and 22' is about 275 mm, while the radius of curvature of the profile of lateral surface 21 is about 600 mm. In order to obtain an optimal running effect of the turns of strand 15 along surface 21, from external turn 15*a* being inlet into rotor 1 coming from the compacting die to internal turn 15*b* being outlet from rotor 1 towards the stranding machine, the ratio between the diameter of drawing drum 12 at containment walls 22, 22' and the diameter at the center of drawing drum 12 is proportional to the ratio between the tension of external turn 15*a* and the tension of internal turn 15*b* of strand 15. By this measure, the turns move automatically in the direction indicated by arrow 23, by rolling clockwise as indicated by arrow 24 if the threads of strand 15 are laid clockwise. Said movement is due to the tendency of strand 15 to shorten itself proportionally to the decrease of the tension and to adjust itself naturally to a circumference of drawing drum 12 which has a proportionally smaller diameter. Particularly, in the present embodiment the external diameter of drawing drum 12 at containment walls 22, 22' is about 916 mm, while the external central diameter of drawing drum 12 is about 900 mm. Therefore, the ratio between the radius of curvature of the profile of lateral surface 21 and the external central diameter of drawing drum 12 is substantially equal to ⅔.

Guide 18 is substantially a ring which can be manually moved along an end of whipping 17 before use and then fixed in a determinate position of the whipping by means of screws. Therefore, guide 18 does not move with respect to whipping 17 during the working of the rotating winch. Guide 18, at the internal end of whipping 17, is placed in a position corresponding longitudinally to that of external turn 15*a* if the threads of strand 15 are laid clockwise. On the contrary, if the threads of strand 15 would be laid anticlockwise, guide 18 can be transversally moved, still at the end of whipping 17, so that the external turn is arranged at containment wall 22', as indicated by broken line 15*c*. In this way, the external turn would roll towards the center of drawing drum 12 anticlockwise and unintentional and dangerous loosening of the threads of strand 15 due to the rolling friction on the external surface of drawing drum 12 can be avoided. Obviously, other embodiments of the present invention can be provided with a pair of guides fixed in opposed positions instead of a single guide 18 which can be moved transversally as a function of the laying up direction of the threads of strand 15, as in the present embodiment.

Further variations and/or additions can be made by those skilled in the art to the herewith described and illustrated embodiment by remaining within the scope of the invention itself.

What is claimed is:

1. Rotating winch for stranding lines which comprises a hollow rotor housing a motor drivingly connected to a drawing drum around an axis perpendicular to the axis of rotation of the rotor, said drawing drum comprising an external lateral surface having a substantially concave profile which is included between two containment walls.

2. Rotating winch according to claim 1, wherein the profile of the external lateral surface of the drawing drum is symmetrical with respect to a central plane perpendicular to the axis of rotation of the drum itself.

3. Rotating winch according to claim 2, wherein the profile of the external lateral surface of the drawing drum has a substantially constant radius of curvature.

4. Rotating winch according to claim 3, wherein the profile of the external lateral surface of the drawing drum has a radius of curvature substantially equal to about the double of the distance between the containment walls.

5. Rotating winch according to claim 4, wherein the distance between the containment walls is about 275 mm and the radius of curvature of the profile of the external lateral surface of the drawing drum is about 600 mm.

6. Rotating winch according to claim 1, wherein the ratio between a diameter of the drawing drum at the containment walls and a diameter at a center of the drawing drum is substantially proportional to a ratio between a tension of a strand going into the rotor and a tension of the same strand coming from the rotor.

7. Rotating winch according to claim 6, wherein the external diameter of the drawing drum at the containment walls is about 916 mm and the central external diameter of the drawing drum is about 900 mm.

8. Rotating winch according to claim 1, wherein the ratio between the radius of curvature of the profile of the external lateral surface of the drawing drum and a diameter at the center of the drawing drum is substantially equal to ⅔.

9. Rotating winch according to claim 8, wherein the radius of curvature of the profile of the external lateral surface of the drawing drum is about 600 mm and the central external diameter of the drawing drum is about 900 mm.

10. Rotating winch according to claim 1, comprising a tubular whipping positioned in the rotor between the drawing drum and an inlet portion for a strand into the rotor, wherein one end of the tubular whipping can be transversally moved with respect to a stranding direction of the threads of the strand.

* * * * *